US005341721A

United States Patent [19]

Kotai et al.

[11] Patent Number: 5,341,721

[45] Date of Patent: Aug. 30, 1994

[54] AMMUNITION DRUM FOR A LARGE CALIBER WEAPON

[75] Inventors: Ference Kotai, Munich; Rudolf Zurek, Gröbenzell; Ingo Bolling, Lnadshut, all of Fed. Rep. of Germany

[73] Assignee: Krauss-Maffei A.G., Fed. Rep. of Germany

[21] Appl. No.: 509,127

[22] Filed: Apr. 16, 1990

[30] Foreign Application Priority Data

Apr. 21, 1989 [DE] Fed. Rep. of Germany ..... 3913173

[51] Int. Cl.[5] ..... F41A 9/13

[52] U.S. Cl. ..... 89/46; 89/47

[58] Field of Search ..... 89/45, 46, 47, 33.02, 89/33.03, 33.1, 34

[56] References Cited

U.S. PATENT DOCUMENTS

| | | | |
|---|---|---|---|
| 372,191 | 10/1887 | Allender | 89/33.03 |
| 2,800,056 | 7/1957 | Atherton, Jr. | 89/33.03 |
| 2,965,004 | 12/1960 | Shoelson et al. | 89/33.03 |
| 3,376,785 | 4/1968 | Elwin | 89/46 |
| 4,840,110 | 6/1989 | Fischer | 89/46 |
| 4,928,574 | 5/1990 | Golden | 89/34 |

FOREIGN PATENT DOCUMENTS

| | | | |
|---|---|---|---|
| 2141937 | 3/1973 | Fed. Rep. of Germany . | |
| 2501424 | 7/1975 | Fed. Rep. of Germany . | |
| 2501425 | 7/1975 | Fed. Rep. of Germany | 89/45 |
| 3046642 | 7/1982 | Fed. Rep. of Germany | 89/47 |
| 3631796 | 4/1987 | Fed. Rep. of Germany . | |
| 3604650 | 8/1987 | Fed. Rep. of Germany . | |
| 1490112 | 10/1977 | United Kingdom . | |

OTHER PUBLICATIONS

Internationale Wehrrevue Jul. 1984, p. 910.

*Primary Examiner*—Stephen M. Johnson
*Attorney, Agent, or Firm*—Robert J. Koch

[57] ABSTRACT

An ammunition drum for a large caliber weapon may have two or more drum elements with parallel rotating axles. The ammunition is located in one or more concentric layers of ammunition holders around the rotating axles. To reduce the structural volume and to simplify the loading process, each of the drum elements may contain a recess extending at least (in the width of an ammunition) partially over the length of the drum element and from the circumference of the drum element at least partially to its rotating axle. The drum elements are located relative to each other in a manner such that in an alternating sequence in the position of one drum element in which its recess is located in the connecting plane between the rotating axles of the drum elements, the other drum element may be positioned with all of its ammunition holders in this connecting plane, from where the ammunition may be transferred in a translatory motion into the weapon.

18 Claims, 1 Drawing Sheet

Fig. 1
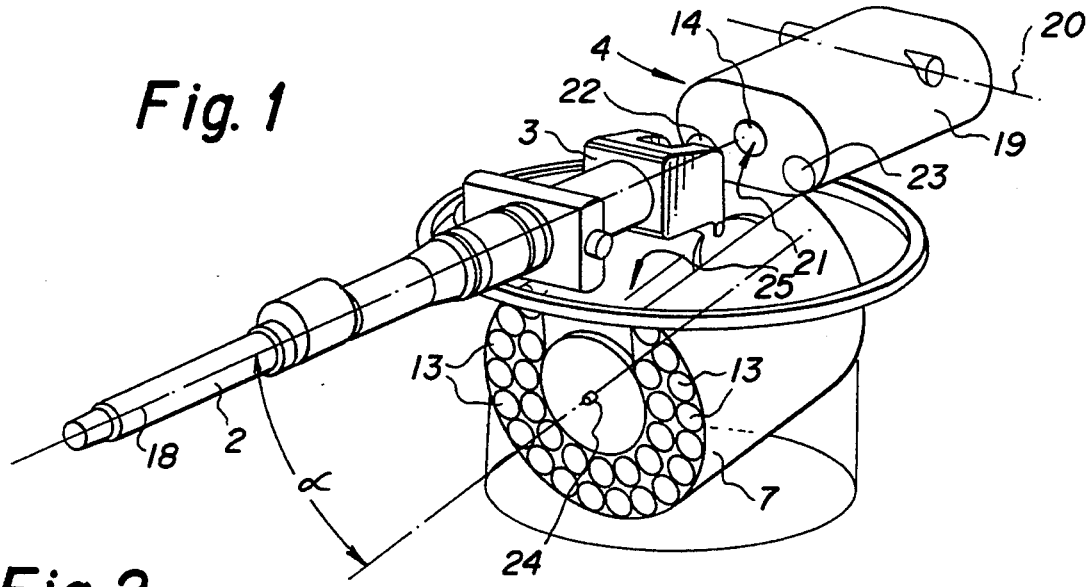
Fig. 2
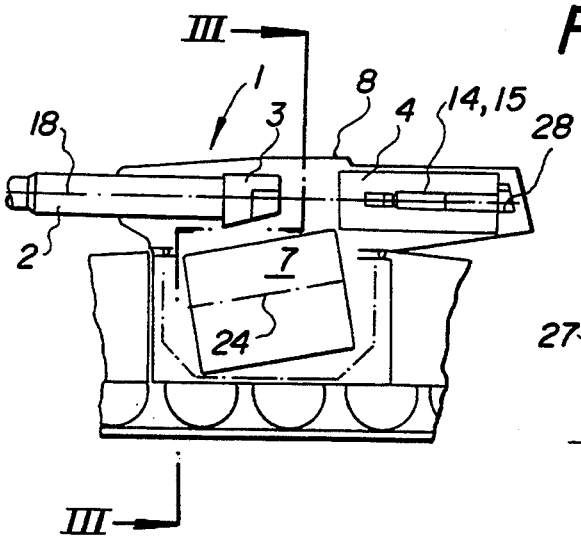
Fig. 3
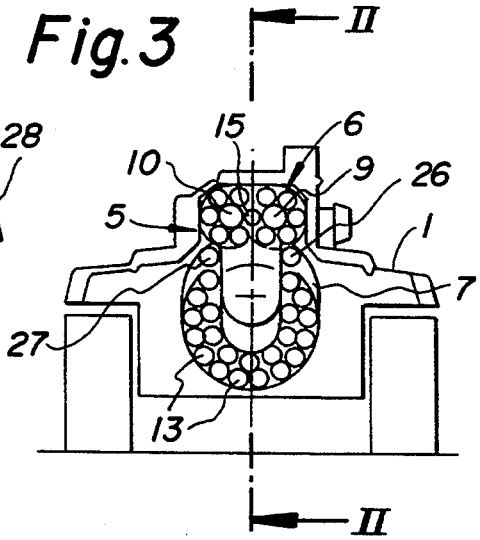
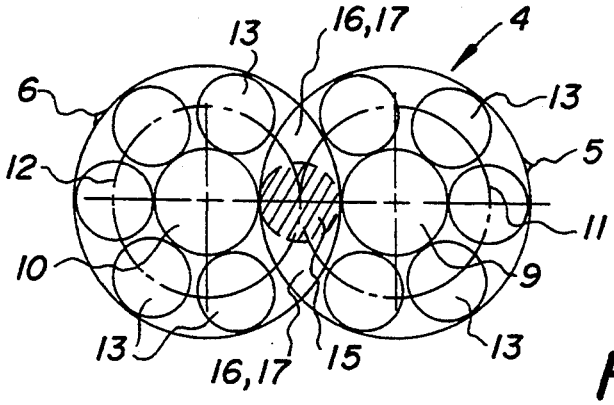
Fig. 4

AMMUNITION DRUM FOR A LARGE CALIBER WEAPON

BACKGROUND OF THE INVENTION

Field of the Invention

The invention relates to an ammunition drum for a large caliber weapon and particularly for an armored vehicle weapon.

Description of the Related Technology

DE-OS 25 01 424 shows an ammunition drum set up with two ammunition magazines located at the rear end of the weapon. One is positioned at each side of a weapon. Magazines of this type require a lot of structural space and have the disadvantage that a loading device is required to take the ammunition separately from each drum.

SUMMARY OF THE INVENTION

It is an object of the invention to reduce the structural volume of an ammunition drum and to simplify the loading process. This object may be attained by an ammunition drum with two or more drum elements on parallel rotating axles. The ammunition may be contained in ammunition holders arranged in one or more concentric layers around a rotating axle. The ammunition holders may come into a superposition location at an intersection of adjacent drum elements between the rotating axles. Each drum element may have a recess or space where two adjacent drum elements alternatingly penetrate each other, in a manner such that in the switching or loading position of one of the drum element is located within said recess. The other drum element may be positioned step-by-step with all of its ammunition holders in the superposition location. The superposition location is the position in which the ammunition may be transferred to the weapon in an essentially in-line manner. Two drum elements behind the breech of the weapon are located with a layer each of ammunition holders. The superposition location is aligned with the bore axis of the weapon in a given indexing position; preferably the horizontal position.

According to a preferred feature the drum elements may be located in a pivoting casing. The casing pivots on a rotating axle transverse to the drum element rotating axles into at least two pivoting positions. Ammunition may be transferred in-line from the superposition location through an ammunition discharge opening into the weapon in the first pivoting position. Ammunition may be refilled from an ammunition refill magazine in the second pivoting position. Ammunition may be reloaded through two ammunition receiving openings provided in the casing in the second pivoting position. Two definite switching positions of the ammunition holders are correlated with the ammunition receiving openings and two discharge positions of the refill ammunition magazine are coordinated with the ammunition receiving openings so that ammunition may be transferred essentially in-line from the refill magazine into the ammunition drum. The refill magazine may be a secondary ammunition drum. The secondary ammunition drum may include a recess at least as wide as a round of ammunition entirely or partially over the axial length of the secondary ammunition drum. The recess may radially extend from the perimeter of the secondary ammunition drum entirety or partially to the rotating axle of the secondary ammunition drum. The rotating axle of the secondary ammunition drum and the bore axis of the weapon are located in one vertical plane. The rotating axle is located at an acute angle a relative to the bore axis of the vertically aligned weapon opening toward the weapon muzzle. The angle corresponds to the second pivoting position of the ammunition drum located behind the breech of the weapon or to the casing angle. Ammunition may be taken or loaded only when aligned in certain common positions of the superpositions. One or more superpositions may be present depending on the number of layers of ammunition holder in the two ammunition drums.

According to a particularly advantageous configuration the ammunition drum may have two drum elements, each with a layer of ammunition holders and a corresponding common superposition location. According to a preferred embodiment an ammunition drum may be located behind the breech of the weapon, so that the superposition location is aligned with the axis of the bore. In the process, the weapon is preferably aligned horizontally. An advantage of this layout is that the ammunition may be moved into the weapon by an in-line translatory motion from the ammunition drum into the weapon. This avoids the disadvantages associated with transverse displacement by a special loading device as shown in DE-OS 25 01 424.

The ammunition drum may be pivot mounted and able to pivot into a first position aligned for transfer of ammunition by an in-line movement into the weapon, and to a second position aligned with a refill magazine. The refill magazine may be a secondary ammunition drum from which ammunition may be transferred to the drum by a simple in-line, translatory motion. Ammunition transfer may be affected when the inclination of the refill magazine or secondary ammunition drum corresponds to the second pivoting position of the ammunition drum.

Weapon loading only requires certain simple loading motions, i.e. a step wise rotation of the drum elements and a straight line or in-line advancing movement. The refill process from a secondary ammunition drum takes place in a similarly simple manner, with only a simple pivoting motion of the ammunition drum required.

An example of the invention is described hereafter with reference to the drawings.

BRIEF DESCRIPTION OF THE DRAWINGS

FIG. 1 is a perspective view of a turret mounted armored vehicle weapon system with an ammunition drum located behind the weapon and a secondary ammunition drum or refill magazine located in a rotating turret.

FIG. 2 shows a section lateral view of an ammunition drum located in the armored vehicle behind the weapon along line II—II in FIG. 3.

FIG. 3 shows a sectional view along line III—III in FIG. 2.

FIG. 4 shows a detailed view of a ammunition drum according to FIG. 3.

DETAILED DESCRIPTION OF THE PREFERRED EMBODIMENT

FIGS. 1 to 3 show a system mounted in an armored vehicle 1 comprising a large caliber weapon 2, an ammunition drum 4 located behind the breech 3 of the weapon 2. Two drum elements or magazines 5, 6 are located behind the weapon 2 and a secondary ammunition drum 7 is located under the weapon 2. All of the aforementioned elements are mounted in the turret 8 of an armored vehicle 1 and may be pivoted together with the turret within the azimuth range.

The drum elements 5 and 6 rotate around axles 9 and 10. The axles 9 and 10 are arranged so that the ammunition holders 13 may intersect at a superposition 15. The ammunition 14 is located in the ammunition holders 13. Each of the drum elements 5 and 6 contains a recess or free space 16 and 17, formed by that each of the concentric layers 11 of the holders 13 of the drum elements 5 and 6 has one ammunition holder 13 missing. This arrangement allows shifting the drum elements 5 and 6 so that every ammunition holder 13 of each of the drum elements 5 and 6 may be brought into the superposition location 15. In the views of FIGS. 3 and 4 the drum elements 5 and 6 are switched so that the superposition is located within the recesses 16 and 17 of the two drum elements 5 and 6. From this initial position a drum element may be switched so that each of the ammunition holders 13 may successively be brought into the superposition location 15. The ammunition holders of the other drum element can then be brought into the superposition location in a similar sequence. In this manner, the ammunition 14 stored in the ammunition holders 13 of the two drum elements 5 and 6 may be moved into the common superposition location.

As seen in FIG. 1 and 2, with a layout of the ammunition drum 4, in which its superposition location 15 is on a straight line with the barrel axis 18 of the horizontally aligned weapon 2, the ammunition 14 may be transferred in a simple manner by an in-line translatorial advance movement to the weapon 2. This advance movement may be effected by simple functional elements 28, such as telescoping push rods or rigid backed chains, located behind the ammunition drum on the line of the axis of the bore and the superposition location.

It is possible in principle to provide ammunition drums in which each of the drum elements has more than one concentric layer of ammunition holders, so that several adjacent superposition locations are obtained on the connecting plane between the rotating axles.

In addition, more than two drum elements may be arranged adjacent to each other, in which case always two adjacent drum elements have one (or several) common superposition locations. Ammunition stored in an intermediate receptacle may be inserted into an empty ammunition holder of an adjacent drum element at a superposition location which is not correlated with the loading orifice of the weapon. The ammunition may be moved in a translatory motion outward into an intermediate receptacle following the appropriate shifting of the drum elements, whereby an empty ammunition holder of the adjacent drum element is switched into the superposition location. The ammunition may then be transferred from one drum element into the other. In this manner a plurality of drum elements may be provided, wherein the ammunition may be moved from one drum element to the other, so that for example the ammunition of all of the drum elements may be transported to a single superposition location.

As seen in particular in FIG. 1, the drum elements 5 and 6 are located in a casing 19. The drum elements 5, 6 and the casing 19 may pivot around a rotating axle 20 in the armored vehicle turret. An ammunition delivery opening 21 is located in the frontal surface of the casing 19 facing the breach 3 of the weapon 2. The ammunition 14 in the superposition location 15 may be transferred in-line into the loading orifice in the breech 3 of the weapon 2 through the delivery opening 21. The frontal surface of the case 19 contains two additional ammunition receiving openings 22 and 23. Ammunition 14 may be loaded from a secondary ammunition drum 7, serving as a refill magazine, through openings 22 and 23 with the ammunition drum pivoted to a downwardly directed position.

The secondary ammunition drum 7 is mounted at an angle relative to the horizontally aligned weapon 2 corresponding to the angle of inclination of the rotating axle 24 of the ammunition drum 4 in the second pivoting position, so that ammunition may be transferred in-line from the ammunition holders 13 of the secondary ammunition drum 7 into the ammunition holders 13 of the drum elements 5 and 6. The transfer may be effected when the secondary ammunition drum 7 is positioned with its refill magazine discharge openings 26, 27 in axial alignment with the ammunition receiving openings 22 and 23.

The secondary drum magazine 7 is provided with a recess 25, which allows an especially space saving correlation of the secondary ammunition drum 7 with the weapon 2. The weapon is able to dip with its breech 3 within its elevation range into the recess. A favorable coordination is achieved relative to the ammunition drum 4, which may be switched into the refill position with a slight angular movement. Ammunition 14 may be transferred merely by a translatory motion in both of the pivoting positions, i.e. from the superposition location 15 of the ammunition drum 4 into the weapon 2 and from the secondary ammunition drum 7 through the ammunition receiving openings 22 and 23 into the ammunition drum 4.

What I claim is:

1. A large caliber armored vehicle ammunition drum comprising:

at least two parallel independently rotatable drum elements wherein each of said drum elements exhibits a plurality of ammunition holders concentrically disposed about a drum element axle in at least one concentric ammunition layer, wherein each of said holders may be moved to an intersection between each of said drum elements;

each of said drum elements further exhibits a recess configured so that adjacent drum elements alternatingly penetrate each other defining a switching position between said adjacent drum elements;

at least one superposition location within said recess;

means for positioning said drum element ammunition holders step-by-step into said superposition location.

2. An ammunition drum according to claim 1, wherein said superposition locations correspond to a position in which ammunition may be transferred to a weapon in an essentially in-line manner.

3. An ammunition drum according to claim 2 wherein said drum element ammunition holder layers are located behind a breech of said weapon and said superposition location is aligned with a bore axis of said weapon when aligned in a predetermined indexing position.

4. Ammunition drum according to claim 3, further comprising a casing housing said drum elements pivoting on a casing axle extending transverse to said drum element axles; said casing may pivot between a first position where ammunition in said superposition is axially aligned with said weapon and a second refill position.

5. An ammunition drum according to claim 4, further comprising means for reloading said drum elements by transfering ammunition in-line from a refill magazine through ammunition discharge openings of said refill magazines and ammunition receiving openings of said casing into an ammunition holder of said drum element when said casing is in said second refill position.

6. An ammunition drum according to claim 5, wherein said refill magazine is a secondary ammunition drum.

7. An ammunition drum according to claim 6, wherein said secondary ammunition drum is configured with a radial recess corresponding in width at least to a diameter of an ammunition round and extending at least partially over an axial length of the secondary ammunition drum and at least partially to the secondary drum rotating axle in a radial direction.

8. An ammunition drum according to claim 7, wherein said secondary ammunition drum rotating axle is vertically aligned with a bore axis of said weapon and an angle defined between said secondary ammunition drum rotating axle and said bore axis corresponds to said casing second refill position.

9. A large caliber ammunition drum suitable for an armored vehicle comprising:

at least two parallel, independently rotating, partially overlapping and intersecting drum elements;

at least one layer of ammunition holders concentrically arranged around a central drum element axle in each of said drum elements wherein each said layer is incomplete and exhibits sufficient spacing to allow alternate rotation of said ammunition holders of said two drum elements into and out of a drum element intersection superposition.

10. An ammunition drum according to claim 9 wherein said drum element intersection superposition is aligned with a weapon.

11. An ammunition drum according to claim 10 wherein said drum element intersection superposition is axially aligned with an indexing position bore axis location behind a breech of said weapon.

12. An ammunition drum according to claim 11 wherein said drum elements are located within a pivoting casing; and further comprising a casing axle connected to said casing transverse to said drum element axle wherein said casing is configured to pivot into a first loading position wherein said drum element intersection superposition is axially aligned with said weapon indexing position bore axis and into a second refill position.

13. An ammunition drum according to claim 12 further comprising:

a refill magazine located adjacent to said casing and displaying a refill magazine discharge opening corresponding to each of said drum elements; and wherein said casing displays an ammunition receiving opening corresponding to each of said drum elements; and wherein said refill magazine discharge opening and said ammunition receiving opening are axially aligned when said casing is in said second refill position.

14. An ammunition drum according to claim 13 wherein said refill magazine is a secondary ammunition drum.

15. An ammunition drum according to claim 14 wherein said secondary ammunition is positioned adjacent to said weapon and exhibits a recess corresponding to the weapon dimensions.

16. An ammunition drum according to claim 11, further comprising means for effecting an inline transfer of an ammunition round from an ammunition holder in said drum element intersection superposition to said weapon bore.

17. A method for loading large caliber weapons comprising the steps of:

alternately moving ammunition holders located in overlapping drum elements into a common drum element intersection superposition;

aligning a weapon bore axis with an axis of said drum element intersection superposition;

axially advancing an ammunition round from said drum element intersection superposition to a breech of said weapon.

18. A method according to claim 17 further comprising the steps of:

aligning a refill magazine discharge opening axis with a drum element ammunition receiving opening axis, and axially advancing an ammunition round from said refill magazine through said discharge and receiving openings into each of said overlapping drum elements.

* * * * *